US011618998B2

(12) United States Patent
Agarwal et al.

(10) Patent No.: US 11,618,998 B2
(45) Date of Patent: Apr. 4, 2023

(54) METHOD OF DYEING TEXTILES WITH LIGNIN

(71) Applicant: The H.D. Lee Company, Inc., Greensboro, NC (US)

(72) Inventors: Dhruv Agarwal, Greensboro, NC (US); Akash Pardeshi, Greensboro, NC (US)

(73) Assignee: The H.D. Lee Company, Inc., Greensboro, NC (US)

( * ) Notice: Subject to any disclaimer, the term of this patent is extended or adjusted under 35 U.S.C. 154(b) by 124 days.

(21) Appl. No.: 17/126,169

(22) Filed: Dec. 18, 2020

(65) Prior Publication Data

US 2021/0285153 A1 Sep. 16, 2021

Related U.S. Application Data

(60) Provisional application No. 62/988,980, filed on Mar. 13, 2020.

(51) Int. Cl.
*D06P 1/46* (2006.01)
*D06P 5/22* (2006.01)
*D06P 3/60* (2006.01)

(52) U.S. Cl.
CPC ..... *D06P 1/46* (2013.01); *D06P 5/22* (2013.01); *D06P 3/605* (2013.01)

(58) Field of Classification Search
CPC ..... D06P 1/46; D06P 5/22; D06P 3/605
See application file for complete search history.

(56) References Cited

U.S. PATENT DOCUMENTS 3,457,022 A * 7/1969 Fields ..... D06P 1/228 8/918
3,961,886 A 6/1976 Hertel et al.
4,184,845 A * 1/1980 Lin ..... C08H 6/00 530/502
4,257,943 A * 3/1981 Hahnle ..... C09B 29/0808 564/441
4,300,900 A * 11/1981 Putzar ..... D06P 3/6033 8/597
5,061,290 A * 10/1991 Koshida ..... D06P 1/228 8/111
5,196,031 A 3/1993 Hook
5,593,459 A * 1/1997 Gamblin ..... C09D 11/03 106/31.35
5,632,782 A 5/1997 Carlough
2006/0042029 A1* 3/2006 Sieber ..... D06P 3/54 8/643

FOREIGN PATENT DOCUMENTS

CN 104830098 * 8/2015 ..... C09B 67/00
WO WO2019145020 8/2019

OTHER PUBLICATIONS

Meryemoglu. Natural dyes from lignocellulosic biomass hydrolysis. Indian Journal of Fibre and Textile Research. vol. 43, Mar. 2018, pp. 92-97.*
Sunthornvarabhas. Antimicrobial kinetic activities of lignin from sugarcane bagasse for textile product. Industrial Crops and Products, 109 (2017) 857-861.*
Notification of Transmittal of the International Search Report and the Written Opinion of the International Searching Authority, of the Declaration, PCT App. No. PCT/US20/65833, dated Mar. 15, 2021, 13 pgs.
Bangladesh Office Action for App. No. 396-2020, dated Feb. 27, 2022, 1 pg.

* cited by examiner

*Primary Examiner* — Amina S Khan
(74) *Attorney, Agent, or Firm* — Womble Bond Dickinson (US) LLP

(57) ABSTRACT

Dye baths including an aqueous solution including lignin in a range of 10% to 30% by weight of the aqueous solution are described. In addition, methods of dyeing fibers, yarns, textiles, or garments with an aqueous solution including 10% to 30% lignin by weight is disclosed. Further, methods of dyeing a fabric including preparing a first dye bath including an aqueous solution having lignin in a range of 10% to 30% by weight of the aqueous solution and passing a fabric through the first dye bath such that the fabric pics up lignin to dye the fabric is disclosed.

8 Claims, 1 Drawing Sheet

METHOD OF DYEING TEXTILES WITH LIGNIN

CROSS-REFERENCE TO RELATED APPLICATION

This application claims the benefit of, and priority to, U.S. Provisional Patent Application Ser. No. 62/988,980, filed Mar. 13, 2020, the entire contents of which are hereby incorporated by reference.

1. TECHNICAL FIELD

The present disclosure relates to dyeing of textiles and, more specifically, to utilizing lignin as a dye stuff to dye textiles.

2. DISCUSSION OF RELATED ART

Lignin is a byproduct of the paper industry, bio-fuel industry, and the echo-chemical industries including cosmetics, pharmaceuticals, etc. These industries utilize the core of trees that are grown in sustainable forests to harvest cellulose and hemi-cellulose to provide raw materials. When the core of the trees is harvested, the outer bark of the trees is typically considered waste. Lignin is found in the outer bark and is the second most abundant polymer from biomass after cellulose. For example, large quantities of lignin are available as a byproduct from the pulping and paper industries. For example, less than two percent of the lignin is recovered for utilization as a chemical product with the remainder being considered waste.

Primarily lignin is used for forming a precursor for forming paper, lignocellulose. Lignocellulose is one third lignin by mass. Lignin can be procured from a variety of trees including, but not limited to, birchwood, eucalyptus, and pine.

SUMMARY

This disclosure relates generally to a dyestuff including lignin as a colorant to dye fibers for use in textiles and methods for using the dyestuff to dye fibers, yarns, textiles, or garments.

In an aspect of the present disclosure, a dye bath includes an aqueous solution including lignin in a range of 10% to 30% by weight of the aqueous solution.

In another aspect of the present disclosure, a method of dyeing a fabric including preparing a first dye bath including an aqueous solution having lignin in a range of 10% to 30% by weight of the aqueous solution and passing a fabric through the first dye bath such that the fabric pics up lignin to dye the fabric.

In another aspect of the present disclosure, a method of dyeing fabric includes preparing a first dye bath comprising an aqueous solution that has lignin in a range of 10% to 30% by weight of the aqueous solution and passing a fabric through the first dye bath such that the fabric picks up lignin to dye the fabric.

In some aspects, the method includes preparing a second dye bath that includes binders or softeners and passing the dyed fabric through the second dye bath. The method may include drying the dyed fabric after passing the dyed fabric through the second ye bath.

In some aspects, passing the fabric through the first dye bath includes multiple dips of the fabric through the first dye bath. Passing the fabric through the first dye bath picks up a range of 90% to 100% by weight of lignin in the aqueous solution. The method may include drying the dyed fabric.

In certain aspects, the method includes preparing the fabric for dying before passing the fabric through the first dye bath. Preparing the fabric for dying may include washing the fabric to remove sizing or other impurities from the fabric, pre-treating the fabric with a cationic pretreatment, selecting a cationic cotton for the fabric, or pre-treating the fabric with an anionic pretreatment.

In another aspect of the present disclosure, a dye bath includes an aqueous solution comprising lignin in a range of 10% to 30% by weight of the aqueous solution.

In aspects, the dye bath includes wetting agents or surfactants in a range of 1% to 3% by weight of the aqueous solution. The aqueous solution may include binders up to 10% by weight of the aqueous solution. The aqueous solution may include softeners in a range of 1% to 3% by weight of the aqueous solution.

In some aspects, the dye bath is configured to dye a cellulosic fiber. For example, the dye bath may be configured to dye cellulosic fibers, a yarn having cellulosic fibers, a fabric having cellulosic fibers, or a garment having cellulosic fibers. The dye bath may be configured to dye fabrics having at least 40% cellulosic content.

In another aspect of the present disclosure, a dye bath includes an aqueous solution comprising lignin in a range of 10% to 30% by weight and binders up to 10% by weight. The aqueous solution being configured to dye cellulosic fibers for use in textiles.

In aspects, the aqueous solution may include wetting agents or surfactants in a range of 1% to 3% by weight of the aqueous solution. The aqueous solution may include softeners in a range of 1% to 3% by weight of the aqueous solution. The aqueous solution may be configured to dye cellulosic fibers in a fiber form, a yarn, a fabric, or a garment.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
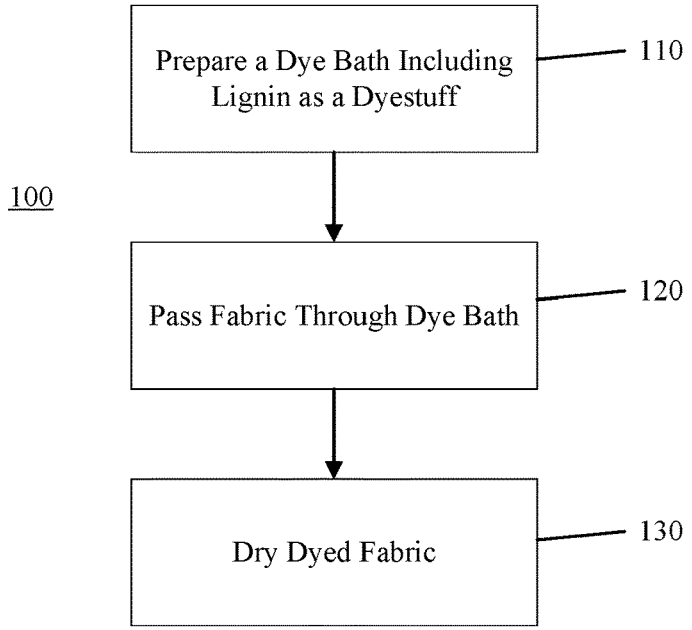
FIG. 1 is a flowchart of a method according to an embodiment of the present disclosure.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

This disclosure is directed to utilizing lignin as a dyestuff to dye fibers, yarns, fabrics, or garments. In some embodiments, this disclosure is directed to utilizing lignin as a dyestuff to dye cellulosic fibers, e.g., cotton fibers, hemp, and regenerated cellulosic fibers. Regenerated cellulosic fibers include, but are not limited to, lyocell, modal, and kapok.

In the textile industry lignin has been used as dye dispersant. However, lignin has not been used in a colorant or as a dyestuff. Lignin represents a component of renewable natural material that is available in sufficient quantity and is not in direct competition with food production like other natural dyes. Suitable lignin may be available from Renmatix, Stora Enso, and others.

Lignin also has inherent properties that are desired for textiles. For example, during the life of a tree, lignin in the outer bark protects the core of the tree from bacteria and fungus and has a natural brown color. When a fiber is dyed with lignin, the fiber is dyed a shade of brown and may acquire properties of lignin such that the fiber is rendered bacteriostatic and/or anti-fungal from the lignin. As disclosed herein, a fabric dyed with lignin may be rendered bacteriostatic and/or anti-fungal.

The methods detailed below have been tested on a lab scale to produce lignin dyed cotton fabrics in various shades of brown. These lignin dyed cotton fabrics have been tested to have good wash fastness for at least ten home launderings. Trials were run with natural cotton rich fabrics and bleached cotton rich fabrics. In some of the trials, the cotton rich fabrics were desized before being dyed. While the methods and results detailed herein are described with cotton fibers, this should not be seen as limiting as similar results are anticipated with other cellulosic fibers including, but not limited to, cellulosic fibers such as wool, linen, hemp, other bast fibers, rayon, viscose fibers, other manufactured cellulosic fibers, recycled cellulosic fibers, and fibers from agricultural waste having cellulosic content. The fabric may have a cellulosic content of at least 40 percent.

With reference to FIG. 1, a method of dyeing a fabric with lignin as a dyestuff is described with respect to an embodiment of the present disclosure and is generally referred to as method 100. The method 100 includes preparing a dye bath including lignin as a dyestuff (Step 110). To prepare the dye bath, lignin powder is dissolved in a medium, e.g., water, to form a lignin solution. When water is the medium, the lignin solution is in an aqueous solution. In embodiments, lignin powder is dissolved in hot water to form a lignin solution. It will be appreciated that lignin easily dissolves in hot water such that medium-high speed stirring is sufficient to dissolve lignin in hot water. The medium-high speed stirring may be in a range of 200 rpm to 1000 rpm. In other embodiments it may be preferred to dissolve lignin powder in cold water. For example, other components of the dye bath may be prematurely activated in a hot water. To dissolve lignin in cold water, high speed stirring in a range of 500 rpm to 1000 rpm may be used to dissolve lignin in cold water. In other embodiments, lignin powder may be dissolved in cold water by high speed blending. For the purposes of this disclosure, cold water is water with a temperature less than 70° F. (21° C.) and hot water is water with a temperature greater than 122° F. (50° C.).

With the lignin in solution, the dye bath is prepared by mixing the lignin solution with one or more other components including, but not limited to, wetting agents, surfactants, binders, and softeners. In some embodiments, lignin may be added or dissolved in the dye bath simultaneously with other components, before other components, or after the other components. In an exemplary dye bath, a lignin powder in solution accounts for 10% to 30%, wetting agents and surfactants account for 1% to 3%, binders account for up to 10%, and softeners account for 1% to 3% of the dye bath by weight. The remainder of the dye bath may be water or other liquids. The dye bath may be formed by dissolving all the components in a liquid sequentially or simultaneously. For example, the lignin powder, wetting agents, surfactants, binder, or softeners may be added to a vat while a medium, e.g., water, in the vat is agitated until all components of the dye bath are dissolved or suspended in the dye bath.

With the dye bath formed, fabric may be padder dyed by passing the fabric through the dye bath such that the lignin in the dye bath is picked up by the fabric (Step 120). The fabric may be passed through the dye bath in a single dip or multiple dips. In trials of cold pad dyeing, pickup of the lignin from the dye bath was in a range of 90% to 100% by weight in each of the trial.

After the fabric is passed through the dye bath, the fabric is dried (Step 130). The fabric may be dried with steam. Additionally or alternatively, the dyed fabric may be dried with dry heat.

Figure 2:
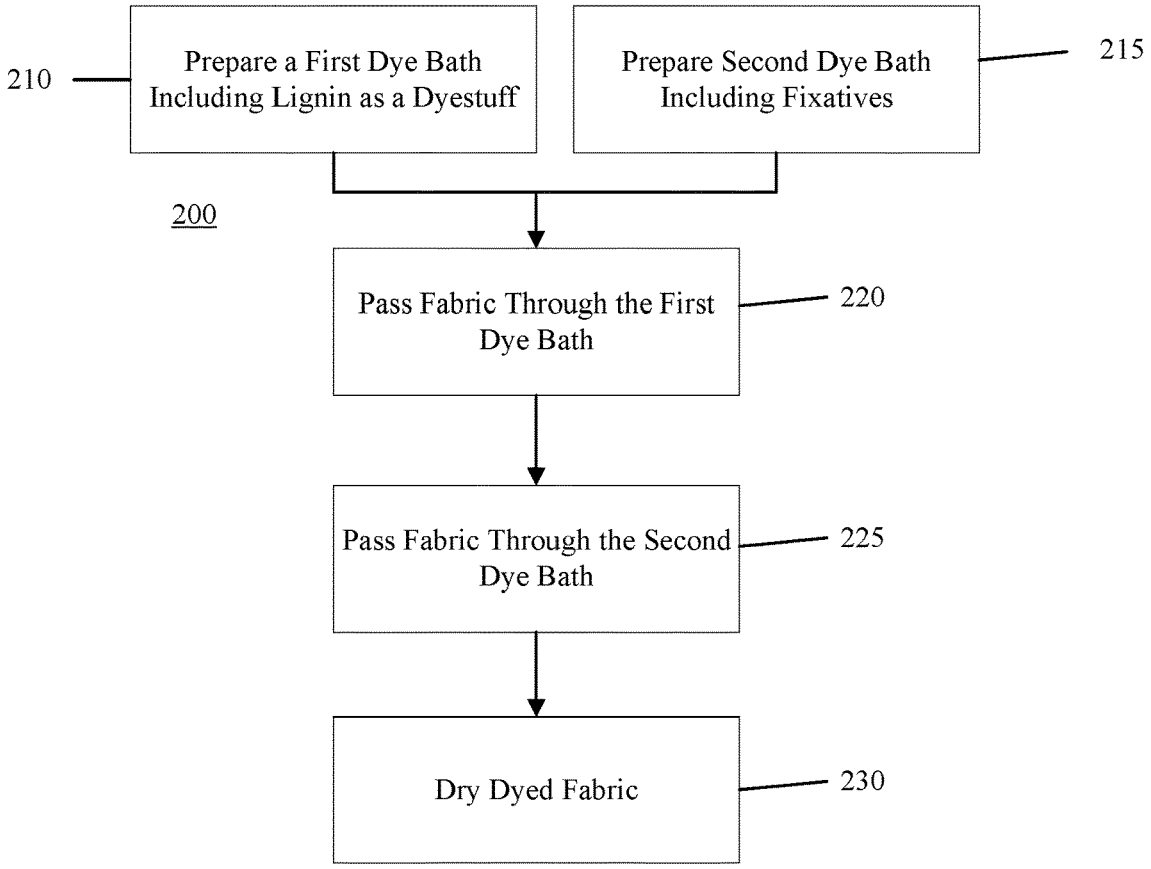
FIG. 2 is a flowchart of another method according to an embodiment of the present disclosure.

With reference to FIG. 2, another method of dyeing a fabric with lignin as a dyestuff is described with respect to an embodiment of the present disclosure and is generally referred to as method 200. The method 200 may include a first dye bath and a second dye bath. The first dye bath may include a lignin solution, wetting agents, and/or surfactants such that the first dye bath includes the colorant or dye, e.g., lignin. The second dye bath may include binders and/or softeners such that the second dye bath includes fixatives. The method 200 includes preparing the first dye bath including lignin as a dyestuff (Step 210) and preparing the second day bath including fixatives (Step 215). The first and second dye baths may be prepared in a manner similar to preparing the dye bath as detailed above with respect to method 100.

With first and second dye baths prepared, a fabric may be padder dyed by passing the fabric through the first dye bath (Step 220) and then passing the fabric through the second dye bath (Step 225). As the fabric passes through the first dye bath, the lignin in the first dye bath is picked up by the fabric. The fabric may be passed through the first dye bath in a single dip or multiple dips. Similarly, the fabric may be passed through the second dye bath in a single dip or multiple dips. In trials of cold pad dyeing, pickup of the lignin from the first dye bath was in a range of 90% to 100% by weight in each of the trials.

After the fabric is passed through the dye bath, the fabric is dried (Step 230). The fabric may be dried with steam. Additionally or alternatively, the dyed fabric may be dried with dry heat.

The methods 100, 200 detailed above may include pretreating the fabric before the fabric is passed through the dye bath. For example, the fabric may be prepared without removing any impurities, the fabric may be washed to remove sizing or other impurities, the fabric may be treated with a cationic or anionic pretreatment, or cationic cotton may be selected. The pretreating of the fabric may improve the consistency of the dyeing process. The pretreating of the fabric may improve the dye pickup and/or other properties of the dyed fabric including color fastness.

The methods 100, 200 detailed above may be used as a batch dyeing process or may be used as a continuous dyeing process. While the dyeing steps detailed above, e.g., Steps 120, 220, 225, are described with respect to fabric padder dyeing, other dyeing processes may be used including, but not limited to, fiber dyeing by stock dyeing or dope dyeing; yarn dyeing by skein dyeing, package dyeing, or beam dyeing; piece dyeing fabric; and garment dyeing.

Examples of suitable wetting agents and surfactants are Ultravon®, Invadine®, or Invalon® each available from Huntsman International LLC. Examples of suitable binders are acrylic, polyurethane binders from earth pigments, Resimax available from Montega Chemical Solutions. Examples of suitable softeners are silicon softeners such as NE 810 available from Wacker Chemicals, DICRYLAN® available form Huntsman International LLC, or Cepreton®.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A method of dyeing fabric, the method comprising:

preparing a first dye bath comprising an aqueous solution having lignin in a range of 10% to 30% by weight of the aqueous solution; and passing a fabric through the first dye bath such that the fabric picks up lignin to dye the fabric.

2. The method according to claim 1, further comprising:

preparing a second dye bath comprising binders or softeners; and passing the dyed fabric through the second dye bath.

3. The method according to claim 2, further comprising drying the dyed fabric after passing the dyed fabric through the second dye bath.

4. The method according to claim 1, wherein passing the fabric through the first dye bath includes multiple dips of the fabric through the first dye bath.

5. The method according to claim 1, wherein passing the fabric through the first dye bath picks up a range of 90% to 100% by weight of lignin in the aqueous solution.

6. The method according to claim 1, further comprising drying the dyed fabric.

7. The method according to claim 1, further comprising preparing the fabric for dyeing before passing the fabric through the first dye bath.

8. The method according to claim 7, wherein preparing the fabric for dyeing includes:

washing the fabric to remove sizing or other impurities from the fabric;

pre-treating the fabric with a cationic pre-treatment;

selecting a cationic cotton for the fabric; or pre-treating the fabric with an anionic pre-treatment.

* * * * *